United States Patent [19]

Voss et al.

[11] 4,388,343

[45] Jun. 14, 1983

[54] METHOD AND APPARATUS FOR LUBRICATING MOLDING TOOLS

[75] Inventors: Gunther Voss, Diessen; Peter Gruber, Biberach, both of Fed. Rep. of Germany

[73] Assignee: Boehringer Ingelheim GmbH, Ingelheim am Rhein, Fed. Rep. of Germany

[21] Appl. No.: 326,168

[22] Filed: Nov. 30, 1981

Related U.S. Application Data

[63] Continuation of Ser. No. 109,360, Jan. 3, 1980, abandoned, which is a continuation-in-part of Ser. No. 94,274, Nov. 14, 1979, abandoned.

[30] Foreign Application Priority Data

Nov. 4, 1978 [DE] Fed. Rep. of Germany ..... 2849496
Aug. 8, 1979 [DE] Fed. Rep. of Germany ..... 2932069

[51] Int. Cl.[3] ..... B05B 5/02; B05B 5/08; B05D 1/04

[52] U.S. Cl. ..... 427/14.1; 239/4; 249/114 R; 425/107; 425/DIG. 115; 427/135

[58] Field of Search ..... 346/75; 264/338; 239/4; 249/114, 115; 425/96, 98, 100, 103, 107, DIG. 115; 427/14.1, 133, 135, 27

[56] References Cited

U.S. PATENT DOCUMENTS

| | | | |
|---|---|---|---|
| 2,512,743 | 6/1950 | Hansell | 239/4 |
| 3,011,213 | 12/1961 | Brandon et al. | 425/100 |
| 3,158,111 | 11/1964 | Raff | 425/DIG. 115 |
| 3,281,860 | 10/1966 | Adams et al. | 239/4 |
| 3,717,875 | 2/1973 | Arciprete et al. | 239/4 |
| 3,960,324 | 6/1976 | Titus et al. | 239/4 |
| 4,018,383 | 4/1977 | Paton | 239/4 |
| 4,047,866 | 9/1977 | Shah | 425/107 |
| 4,138,687 | 2/1979 | Cha et al. | 346/75 |
| 4,153,467 | 5/1979 | Yano et al. | 346/75 |
| 4,188,635 | 2/1980 | Giordano et al. | 346/75 |

FOREIGN PATENT DOCUMENTS

| | | | |
|---|---|---|---|
| 1937500 | 11/1970 | Fed. Rep. of Germany | 427/135 |

*Primary Examiner*—John H. Newsome
*Attorney, Agent, or Firm*—Hammond & Littell, Weissenberger and Muserlian

[57] ABSTRACT

A method and apparatus for the coating of molding tools which comprises dispersing liquid or suspended lubricant in directional manner before each pressing operation in discrete, specific droplets onto the pressing zones of the molding tools, said dispersing being effected by means of f.i. piezoelectric transducers.

11 Claims, 6 Drawing Figures

METHOD AND APPARATUS FOR LUBRICATING MOLDING TOOLS

CROSS-REFERENCE TO RELATED APPLICATION

This application is a continuation of U.S. patent application Ser. No. 109,360, filed Jan. 3, 1980, which in turn is a continuation-in-part of copending U.S. patent application Ser. No. 094,274 filed Nov. 14, 1979, now abandoned.

This invention relates to a method and apparatus for spraying molding tools. More particularly, this invention relates to a method and apparatus for dotting molding tools, for example, those of tableting machines, with discrete droplets of liquid or suspended lubricants in the manufacture of molded products in the field of pharmaceuticals, foodstuffs, or catalysts.

BACKGROUND OF THE INVENTION

In copending U.S. patent application Ser. No. 897,571, filed Apr. 19, 1978, incorporated herein by reference, a method for the coating of press compartments, i.e., die chambers, on tableting machines is described. The method is characterized in that dissolved or melted lubricants are applied to the inner walls of the press compartments before each pressing operation by means of a nozzle system spraying intermittently and briefly at rapid intervals.

It has been shown in the meantime that with the new high-performance tableting machines, a hydraulically operated intermittent spraying system is still too slow-acting to coat the molding tools before each pressing operation. Moreover, it is fundamentally desirable to keep as small as possible the quantity of lubricant (to achieve an optimal bioavailability, moldability, and a straight-forward and undelayed dissolution of dissolving tablets, e.g., for diagnostic purposes or effervescent tablets). It is therefore necessary that the spraying system be especially capable of applying rapidly in concentrated form the required quantity of lubricant to pressing zones of the molding tools (e.g., the pressing zone in the die cavity) in the shortest possible time, e.g., in a few milliseconds, intermittently, and in a directional manner.

DESCRIPTION OF THE INVENTION

Figure 1:
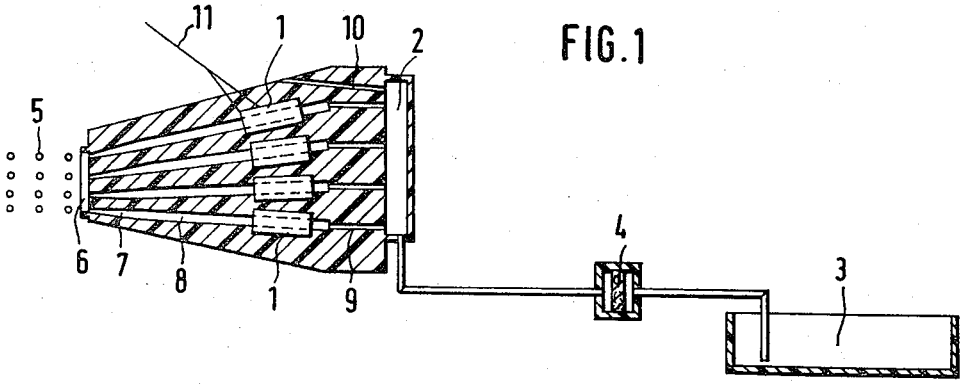
FIG. 1 represents a cross-section of one embodiment of the dotting system of this invention.

It has been found that these requirements can be met in a superior way if liquid or suspended lubricant is dispersed, i.e., dotted, in a directional manner onto the loading, i.e., pressing zones of the pressing tools before each pressing operation in specific quantities and in the form of discrete droplets of specific volume. The dotting is effected by means of tube-shaped or plate-shaped piezoelectric transducers, intermittently before each pressing operation. However, a lubricant liquid or suspension can also be broken into discrete droplets of specific volume after application of a high pressure during passage through a narrow nozzle, whereby the individual droplets are successively charged electrically and are intermittently deflected electrostatically to dot the loaded zones of the pressing tools.

A system suitable for dotting the liquid or suspended lubricant consists, e.g., of an entire row of channels such that a tube-shaped piezoceramic oscillator concentrically encases a section of each channel. Conductive layers, e.g., silver layers or gold or nickel layers, on the faces of the tube-shaped piezoceramic oscillator, serve as electrodes to apply the electrical field.

The outlet openings of the channels are nozzle-shaped and are aligned so that each individual opening disperses, i.e., dots, a certain region of the passing molding tools with fine droplets of lubricant. The individual channels are connected on their feed side, e.g., to a common distributor plate which is connected to a supply container and are provided, i.e., supplied, therefrom with lubricant liquid or suspension. (See, FIG. 1.).

Backflow of the liquid or suspension in the nozzle channel is obstructed, for example, due to the nozzle channel being narrowed towards the outlet opening. As a result of the characteristic of piezoceramic oscillators to undergo an elastic deformation upon the application of a specific electrical field, a shock wave directed to the liquid arises in the tube-shaped piezoceramic oscillators. The pressure increase associated therewith leads to the ejection of very small quantities of lubricant in lobe, or nodule, form from the outlet openings, these lobes, or nodules, of lubricant assuming a spherical form after leaving the outlet openings. The diameter of a channel is advantageously about 1 mm in its middle part, the individual channel being narrowed at its outlet opening. The diameter of the outlet opening is, e.g., about 0.1 mm.

The supply container lies lower than the outlet openings, which gives rise to a vacuum system. Due to the height difference, a static vacuum arises in the channels. This static vacuum is overcompensated for a brief moment in the channels upon application of the electrical field, in conjunction with capillary action.

The capillary forces in the channels and in the outlet openings prevent the lubricant liquid or suspension from running back.

Thus, for example, 3000 droplets leave the opening with a drop frequency of 3 kHz and a lubricant viscosity of about 20 mPas. The velocity of the droplets is about 4 m/sec with a very constant droplet weight of about 0.8 $\mu$g (0.0008 mg). Depending upon the electronic control, the drop frequency lies between a few hundred Hertz, e.g., three hundred Hertz, and 50 kHz, preferably around 3 kHz. The excitation of the piezoelectric oscillators is effected, e.g., with a voltage pulse of 120 volts and a pulse duration of 20 microseconds.

The channel which is surrounded by the piezoceramic oscillator may be curved arbitrarily in front of or behind said oscillator. This form of arrangement, i.e. realization, serves for better adaptation to the spatial conditions, e.g., of the tablet press. However, the channel may also be branched into two or more channels spatially after the piezoceramic oscillator, so that one piezoelectric oscillator supplies, i.e., acts upon, several channels with separate outlet openings. The outlet openings may be, e.g., holes in a glass or metal plate. If the channel consists of a glass capillary tube, then the outlet opening may be formed by drawing out the glass tube at its end.

Another advantageous form of arrangement for application of the liquid or suspended lubricant consists of using plate-shaped or planar transducers which work on the piezoelectric principle and which are fitted, preferably concentrically, above the entrance of the channels. In this arrangement, narrowed outlet openings are situated at the end of the channels. In a preferred form of arrangement, the piezoelectric plate lies horizontally concentrically to the channel leading away vertically. The piezoelectric plates lie in or on a compartment for receiving the lubricant liquid or suspension. Several channels may be connected to, i.e., lead away from, a common compartment which is connected, in turn, to a common liquid supply. Thus, e.g., a planar oscillator (piezoelectric plate) can also simultaneously generate a pressure wave in several channels connected to the same distributor compartment.

A further advantageous, constructively simplified arrangement comprises a planar oscillator of strong stroke in the distributor compartment and a channel which departs from the distributor compartment and runs preferably vertically to the planar oscillator, the channel having situated at its end several nozzles optionally aligned variously in space or an entire nozzle rim. Due to such an arrangement a surface dotting can be obtained with a single stroke generated by the piezoelectric oscillator. (See, FIGS. *2a, 2b,* and *2c.*)

With high-performance tableting machines, the top die, or force, or the bottom die with the cavity, runs past the dotting system in a few milliseconds. Nevertheless, a channel which works with a drop frequency of a few kHz can deliver during this time not only one, but a whole series of lubricant droplets. The control of a dotting system consisting of a larger number of channels with outlet openings may be effected in such a way that all channels spray either simultaneously upon the appearance of the molding tools or staggered in time according to their geometric arrangement. Moreover, it is possible to select the droplet frequency of the channels differently depending on which region of the molding tools is to be dotted. Thus, more lubricant can be applied in a directional manner to special zones of the molding tools (e.g., to the pressing zone in the cavity or to the engraving region of the top or bottom die face) than to less loaded zones. Finally, there is the possibility of feeding the channels which dot the cavity wall with a different lubricant solution from that of the channels which are provided for dotting the surfaces of the die faces.

To concentratedly apply the droplets generated by piezoelectric transducers to the desired surfaces of the molding tools, it is advantageous in many cases to control the path of the droplets after they leave the outlet openings by means of electrostatic or electromagnetic deflection. This conttrol can be effected by conventional means, such as, for example, by using the principle of cathode-ray deflection in a television tube.

The piezoceramic bodies may also be used as valves if the lubricant liquid or suspension is supplied under pressure to the oscillator or transducer which opens or closes according to selection. Upon selection, an opening, e.g., a slit-shaped opening, opens briefly in a channel containing the liquid under pressure and the lubricant is delivered through said opening in drop form. The opening may be fashioned in the oscillator itself, the oscillator acting as a valve closing the space standing under pressure, or in the zone between the oscillator and the material forming the walls of the channel. This operation is possible also in reverse, whereby upon selection the oscillator closes the space standing under pressure.

The drops necessary for dotting may also be generated by the so-called high-pressure process. According to the high-pressure process, the active substance liquid or suspension is pressed under high pressure through one or more narrow nozzles. The high pressure is generated by, for example, a pump. Immediately after leaving the nozzle, the liquid is divided into fine droplets of uniform size which are subsequently charged by a charging electrode. The electrically charged droplets are deflected electrostatically to the desired points of the pressing tools. (See, FIG. 3).

The high-pressure nozzle may also be situated concentrically in the middle of a tube filled with lubricant liquid or suspension. The outlet opening of the high-pressure nozzle is situated just below the level of the lubricant liquid. From the high-pressure nozzle there emerges a carrier or transport liquid as a jet which carries with it up to about 50% of the lubricant liquid or suspension surrounding it. This liquid jet of carrier and lubricant liquid standing under high pressure is decomposed immediately after leaving the nozzle-shaped opening of the tube into uniform droplets which after electrical charging are deflected electrostatically in the direction of the points of the pressing tools to be dotted. Suitable transport liquids include, for example, water, alcohols such as the lower alkanols, including methanol and ethanol, or glycol, and glycerine. The diameter of the nozzle is, for example, about 10 $\mu$m, and the diameter of the surrounding tube is about 2 mm. Also, coarse lubricant suspensions can be dotted with this arrangement. (See, FIG. 4.)

The droplets generated by the above-described high-pressure system have a diameter of, for example, about 20 $\mu$m. These droplets can, if desired, be further divided by the application of a strong electrical field of, for example, about 500 to 1000 volts. These finer charged droplets may in addition be used for the directed dotting of the pressing tools due to electrostatic deflection.

However, with high-performance tableting machines, it may also be advantageous to accelerate the discrete droplets of lubricant on their way to the molding tools by a directed and dosed air stream. This directed air stream can be produced easily from, for example, a contact-controlled nozzle connected to a compressed air system.

The dotting system may be fitted anywhere in front of the filling shoe, or container, and behind the ejector device of a tableting machine. However, it is especially appropriate to arrange the spray opening of the spraying system about 1 mm above the dial feed in which the cavities are situated, so that it is possible to disperse, or dot, directly from above into the "cup" formed from the cavity bore and the die face of the bottom die. It is even possible to dot directly into the gap between the cavity and bottom die.

The control signal for releasing the intermittent and precisely directed dotting is obtained by, for example, means of photocells or inductive or capacitive proximity switches.

To ensure that, for example, tablet presses cannot work without lubrication, flow monitors are inserted, as a rule, in the lubricant and, where appropriate, air flow, which transmit a pulse, when necessary to switch off the machine.

Due to the relatively high impact velocity, parts of the lubricant can be lost or be deposited at undesirable points. However, this can be prevented, if desired, by the attachment of one or more suction heads. It is possible to check the quantity of lubricant applied per shot, for example, by placing a piece of absorbent paper on the cup formed by the matrix bore and active part of the lower die, spraying the cup consecutively with 100 or 1000 shots of lubricant, weighing the piece of paper, and dividing the weight gain by 100 or 1000.

The lubricant is used in liquid, dissolved or suspended, or even molten form. Therefore, substances to be converted especially easily into this form are, for example, fatty acids and their salts; the so-called metal soaps, such as magnesium stearate; also, fatty acid esters, especially those with polyols such as glycerin, as well as higher aliphatic alcohols or polyethylene glycols; or also separating agents such as paraffin or silicone oil. Lower aliphatic alcohols, such as ethanol or isopropanol, are appropriately used as solvents.

In addition to lubricant solutions and suspensions, even lubricant melts can be used if the spraying head is heated to the appropriate temperature by a built-in heating plate. A heated supply container and hose ensure the conveyance of the lubricant to the spraying head. Lubricants useful with such a "hot melt" system include low-melting, so-called "plastic" lubricants such as glycerin and monostearate (GMS) or mixtures of this substance with glycerin distearate or tristearate.

All lubricant liquids are conveyed to the channels advantageously via a suitable small filter.

FIG. 1 shows schematically in cross-section a dotting system with piezoelectric transducers (1) which each encase a nozzle channel (8). The nozzle channel (8) terminates in a narrowing (7), and the individual narrowings (7) are present at corresponding openings of an outlet nozzle plate (6), whereby the nozzles formed by the narrowings (7) and the openings of the outlet plate (6) deliver droplets of liquid (5) when the device is actuated. The nozzle channel (8) is connected via a narrowed liquid channel (9) to a liquid distributor compartment (2). The distributor compartment (2) has a vent channel (10), and the distributor compartment is connected via a filter plate (4) to a liquid supply container (3). The electrical control of the piezoelectric transducers is effected via contacts (11).

Figure 2A:
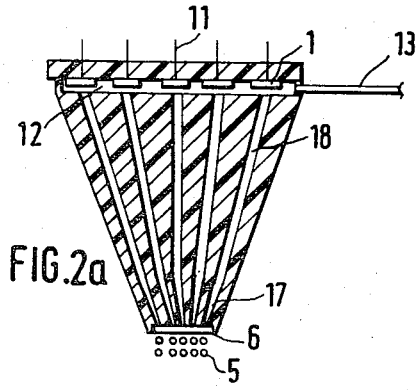
FIGS. 2*a*, 2*b*, and 2*c* represent cross-sections of different dotting heads with planar transducers.
Figure 2B:
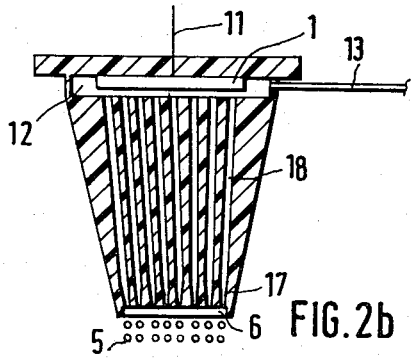
Figure 2C:
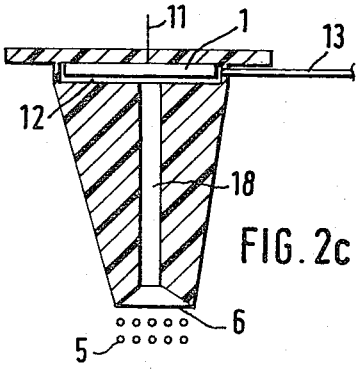

FIGS. 2*a*, 2*b*, and 2*c* represent cross-sections of variously constructed dotting heads with planar transducers working on the piezoelectric principle. Here, planar piezoelectric transducers (1) have contacts (11) for electrical control. The planar piezoelectric transducers lie in a liquid distributor compartment (12) which is connected via the liquid line (13) to a supply container. One or more nozzle channels (18), whose narrowings (17) terminate at an outlet nozzle plate (6), lead away from the distributor compartment (12). Liquid droplets (5) are released from the nozzle plate (6).

Figure 3:
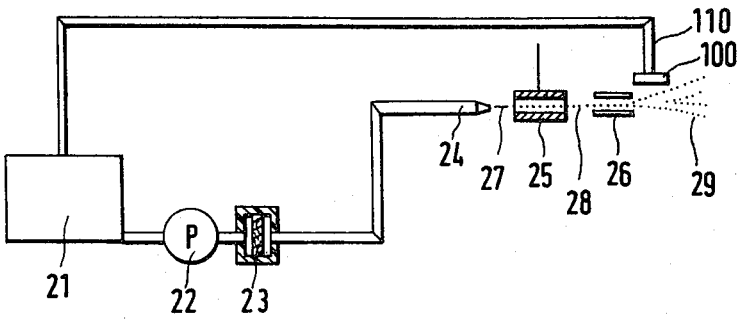
FIGS. 3 and 4 represent cross-sections of high pressure dotting systems.

FIG. 3 is a schematic cross-section of a so-called high-pressure dotting system. From a liquid supply container (21) liquid is pressed by means of a pump (22) through a filter (23) into a nozzle (24). A liquid jet (27) released at the nozzle (24) is decomposed, i.e., broken, into drops (28) which are charged electrically by a drop charging ring (25) and are deflected by means of a deflector plate (26) in an electrical field. The deflected liquid drops (29) dot the pressing tools. The remaining, i.e., undeflected, drops (29) are drawn up by a suction electrode (100) and collected and are returned to the container (21) via line (110).

Figure 4:
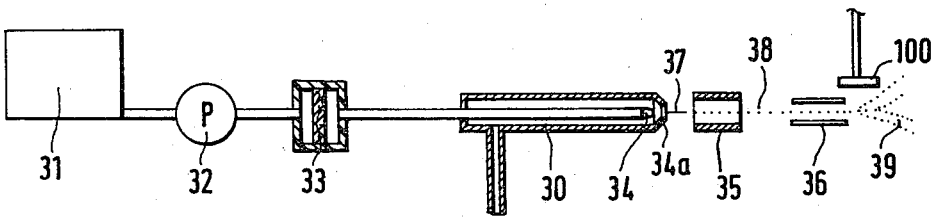

FIG. 4 shows a cross-section of a high-pressure dotting system in which the lubricant is conveyed by a transport liquid. The liquid supply container (31) contains the transport liquid which is pressed by the pump (32) through a filter (33) into the nozzle (34). The tube (30) contains the lubricant liquid or suspension which is carried along at the nozzle (34*a*) by the jet (37) of transport liquid released at the nozzle (34); the combined jet (37) decomposes into drops (38) which are charged electrically by the drop charging ring (35). The drops (38) are deflected upon passing the deflector plates (36) electrostatically into the desired direction, the deflected drops (39) dotting the pressing tools at specific points. The undeflected drops are removed by a suction electrode (100).

Altogether, the following advantages of this dotting system are to be emphasized:

The system works without any mechanical mechanism with the use of piezoelectric oscillators and therefore undergoes practically no wear. Even the supply of the dotting liquid is effected independently due to the capillary forces of the channels.

The droplet formation is stable and of the highest precision, irrespective of whether a few hundred or 15,000 droplets per second are delivered by the channel. The dotting head may be sized so that it can be attached even to the smallest tablet press or capsule machine. The dotting head can be aligned so that it delivers the droplets in all the desired directions.

The dotting head deliveres only droplets of the same weight in contrast to a single substance or double-substance nozzle with droplet distributions between a mist and coarse drops.

With the dotting systems described, the rapid and exact mode of operation is to be emphasized. The systems are suitable for all hitherto known high-speed tablet presses. The delivery of lubricating liquid or suspension can be effected in less than one millisecond. The quantities delivered are constant. The lubricant is applied exactly at the points of the tools where the lubricant must necessarily be used. The hitherto known systems, for example, the spraying of lubricant liquids from a nozzle, produce droplet distributions between a mist and coarse drops, whereby the coarse drops prevent a homogeneous distribution of the lubricant and the mist leads to contamination of the press plate of tablet machine. With the hitherto known systems it was not possible to apply concentratedly to the especially stressed zones of the press tools in a consistent way more lubricant than to less stressed places.

In a broader sense, the invention herein is applicable to all machines which compress masses of different composition into molded articles, for example, in the pharmaceutical industry for the manufacture of capsules or tablets, and in the food industry for the manufacture of compressed articles or the manufacture of molded articles from ceramic masses, or of catalyst masses. The method is highly suitable for so-called high-speed machines with an output of 250,000 or more pressed articles per hour (at one press point, single tool).

The following examples illustrate the present invention and will enable others skilled in the art to understand it more completely. It should be understood, however, that the invention is not limited solely to these particular examples.

EXAMPLE I

Forty kilograms of indomethacine, 159 kg of lactose, 200 kg of corn starch, 14 kg of colloidal silicic acid, and 6 kg of polyvinyl pyrrolidone were granulated in the conventional way after intensive mixing. For this purpose, an aqueous solution of 10 kg of soluble starch was used.

The granulate was pressed in a double rotary press with an output of 220,000 tablets per hour, the cavity wall and the active die faces were dotted by means of a dotting system working piezoceramically and filled with a semi-saturated solution of glycerine monostearate in ethanol. In so doing, the 24 tubes worked at a frequency of 10 droplets per millisecond and the pressing tools could be dotted for about 5 milliseconds during these passage. The droplet weight was approximately 0.6 μg (0.0006 mg). The maximum breaking strength at the specified tableting speed was 35% higher in comparison with tablets having 1.0% magnesium stearate in the granulate.

EXAMPLE II

A powder mixture for hard gelatin capsules prepared from an active substance A, lactose, corn starch and colloidal silicic acid. A dotting device was attached about 1 mm underneath the passing filling tube of a capsule-filling machine. A planar piezoelectric oscillator was situated above the liquid channel of this apparatus, and the end of the channel was closed by a nozzle plate with 42 bores 0.06 mm in diameter. During one millisecond 0.1 mg of a 5% alcoholic magnesium stearate suspension was delivered to the inside of the passing filling tube. The tested in vitro release of the active substance from this capsule was substantially quicker (90% release of active substance in 10 minutes instead of 35) in comparison with a capsule prepared according to conventional technology (with 2% magnesium stearate in the granulate).

While the present invention has been illustrated with the aid of certain specific embodiments thereof, it will be readily apparent to others skilled in the art that the invention is not limited to these particular embodiments, and that various changes and modifications may be made without departing from the spirit of the inventions or the scope of the appended claims.

We claim:

1. In a method of preparing tablets from a granulate material comprising introducing granulate material into a mold die cavity, compressing the granulate material in the mold die cavity with a cooperating punch to form tablets, and ejecting the tablets from the mold die cavity, the improvement which comprises forming a lubricant film over substantially the entire mating surfaces of the mold die cavity and cooperating punch by selectively dotting liquid or suspended lubricant in specific quantities and in the form of discrete droplets by piezoelectric means onto a small portion of said mating surfaces to provide complete lubrication of the mating surfaces.

2. The method of claim 1, wherein the intermittent dotting of the liquid or suspended lubricant is effected using tube-shaped or plate-shaped piezoelectric transducers.

3. The method of claim 1, wherein the discrete droplets are formed under high-pressure and have a specific volume and wherein the individual droplets are successively charged electrically and intermittently deflected electromagnetically to the mating surfaces.

4. The method of claim 1, wherein certain regions of the mating surfaces are dotted with lubricant droplets at concentrations independent of one another.

5. The method of claim 1, wherein certain regions of the mating surfaces are dotted independently of one another with lubricant droplets of various types.

6. In an apparatus for preparing tablets from a granulate material comprising means for introducing granulate material into a mold die cavity, means for compressing the granulate material in the mold die cavity with a cooperating punch to form tablets, and means for ejecting the tablets from the mold die cavity, the improvement which comprises piezoelectric means for forming a lubricant film over substantially the entire mating surfaces of the mold die cavity and cooperating punch by selectively dotting liquid or suspended lubricant in specific quantities and in the form of discrete droplets onto a small portion of said mating surfaces to provide complete lubrication of the mating surfaces.

7. The apparatus of claim 6, wherein the piezoelectric means comprises one or more piezoelectric transducers which each wholly or partly enclose one or more channels containing round or slit-shaped outlet openings laterally or at one of their ends, the channels terminating at narrowed outlet openings and the channels being connected to a supply container for the liquid.

8. The apparatus of claim 7, wherein the piezoelectric transducer contain one or more round or slit-shaped outlet openings as integrated constituents of a liquid channel.

9. The apparatus of claim 7, wherein the channels are curved in front of or behind the piezoelectric transducers or are each branched into two or more channels after the piezoelectric transducers, or both, and the piezoelectric transducers are each assisted by one or more other piezoelectric transducers.

10. The apparatus of claim 6, wherein the piezoelectric means comprises a plate-shaped or planar transducer working on the piezoelectric principle fitted horizontally above the entrance of one or more channels which lead away vertically and which have narrowed outlet openings at the other end.

11. The apparatus of claim 6, which comprises a high-pressure nozzle releasing a carrier or transport liquid situated concentrically in a nozzle-shaped tube containing the lubricant liquid or suspension, the outlet opening of the high-pressure nozzle coming to rest just beneath the level of the lubricant liquid or suspension, whereby the carrier or transport liquid jet escaping under high pressure from the high-pressure nozzle carries with it a corresponding portion of the lubricant liquid or suspension surrounding it, and the jet thus loaded is divided into uniform droplets; means for electrically charging the uniform droplets; and means for electrostatically deflecting the charged uniform droplets onto the mating surfaces.

* * * * *